United States Patent [19]

Socas

[11] 4,040,585

[45] Aug. 9, 1977

[54] ADJUSTABLE PROJECTOR TABLE

[76] Inventor: Eduardo L. Socas, 4113 Ortisi Drive, Orlando, Fla. 32807

[21] Appl. No.: 687,524

[22] Filed: May 18, 1976

[51] Int. Cl.[2] ..... F16M 1/00

[52] U.S. Cl. ..... 248/11; 248/371

[58] Field of Search ..... 248/11, 371, 372, 380, 248/381, 397; 108/1

[56] References Cited

U.S. PATENT DOCUMENTS

| | | | |
|---|---|---|---|
| 1,838,750 | 12/1931 | Dina | 248/11 |
| 3,406,933 | 10/1968 | Wait et al. | 248/371 X |
| 3,968,949 | 7/1976 | Romano | 248/11 |

FOREIGN PATENT DOCUMENTS

| | | | |
|---|---|---|---|
| 113,202 | 1/1926 | France | 248/11 |

*Primary Examiner*—William H. Schultz

*Attorney, Agent, or Firm*—Macdonald J. Wiggins

[57] ABSTRACT

A table for supporting a slide projector, motion picture projector or the like that can be quickly, easily, and accurately adjusted to place the height of the projected image at a desired height on the viewing screen. The table comprises a top, a rear leg assembly and a front leg assembly pivotally attached to the top, pivotally connected link braces linking the rear and front leg assemblies, and means for locking the legs in a selected angular relationship with the top. When the locking means is released, the leg assemblies can be pivoted causing the table top to move from a level position in which the front edge of the top is tilted upward to any desired degree and the locking device reengaged. The table can also be collapsed or folded and locked in such position for storing. An improved implementation of the table provides a simple vernier adjustment for the tilt of the table top.

7 Claims, 9 Drawing Figures

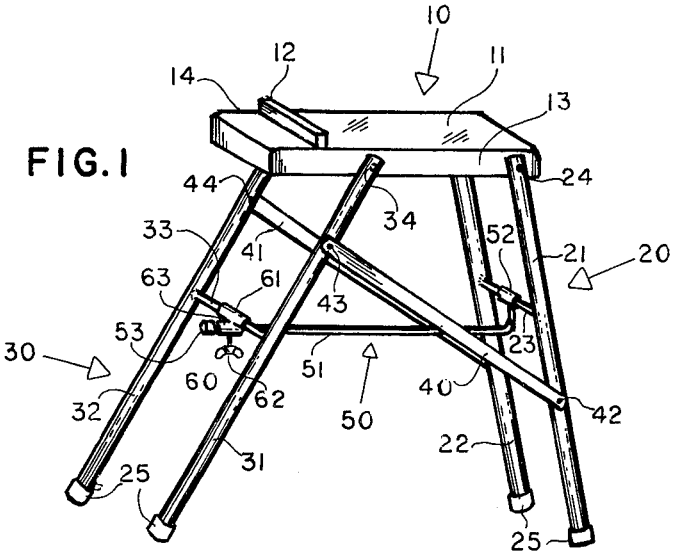
FIG. 1
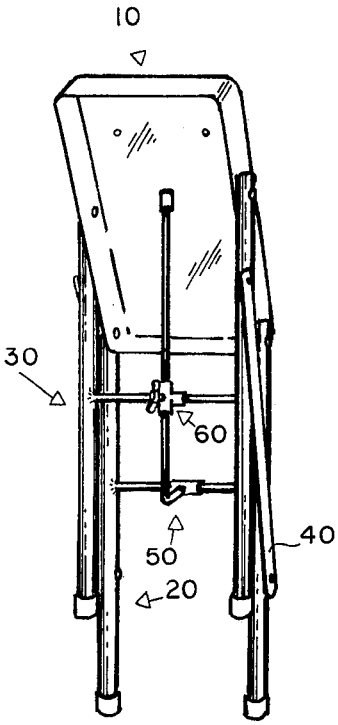
FIG. 3
FIG. 2
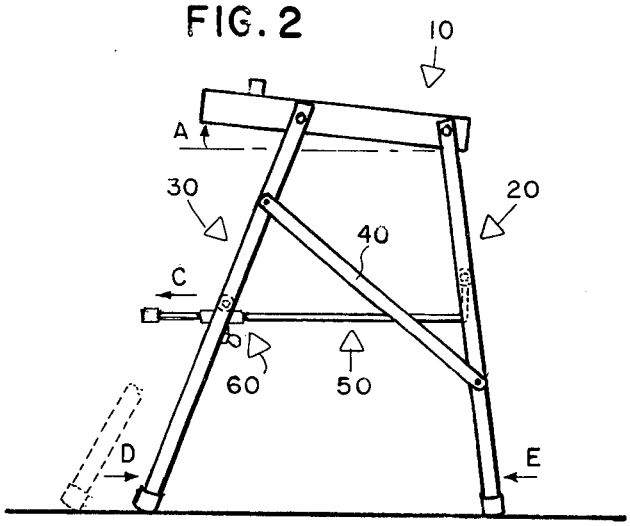
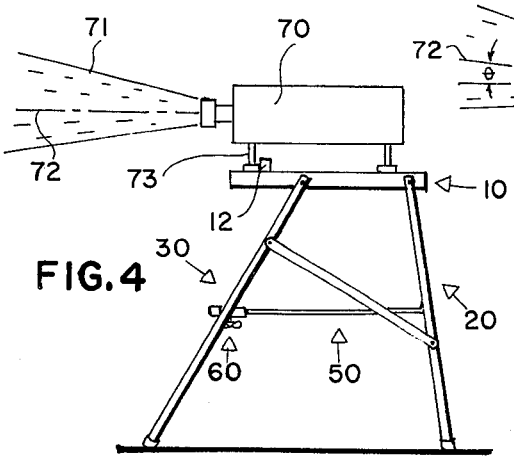
FIG. 4
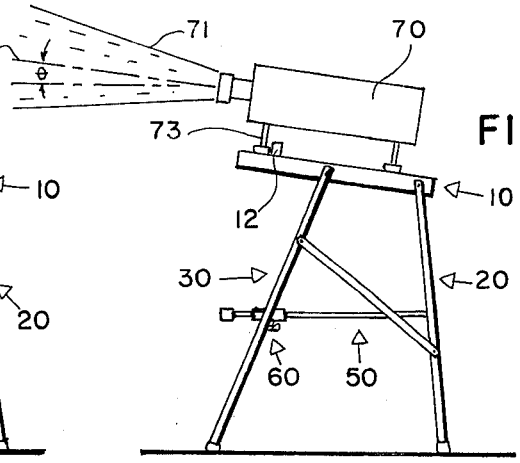
FIG. 5

ADJUSTABLE PROJECTOR TABLE

BACKGROUND OF THE INVENTION

1. Field of the Invention

This invention relates to the tables for supporting slide projectors, portable motion picture projectors and the like, and more specifically to adjustable and collapsible tables.

2. Description of the Prior Art

Slide projectors and motion picture projectors of the portable type generally require a table or support when in use. The table serves to place the projector at a convenient height for the operator to control and also to allow the projected image to fall on the screen, wall or other viewing surface at a height above the floor convenient to the viewers. Certain of known projector tables are collapsible for storage and open out to place the table top in a position parallel with the floor and at a fixed height above the floor. Other known tables include means for adjusting the table top height vertically while maintaining the level attitude of the top.

For many situations, it is desirable to have the projected image well above the viewer's eye level. For example, lecture, halls, classrooms and the like often have roll-up screens attached at ceiling height which are pulled down for use. To raise the projected image, most projectors have adjustable feet at the front end which can be extended to a limited degree. Typical adjustments require rotation with the fingers of two feet threaded into the projector base. Such adjustments are slow and somewhat awkward. Due to the limited adjustment usually available, the operator cannot, on many occasions, raise the image sufficiently and resorts to books, boxes, or other makeshift props under the front end to provide additional height. Suffice to say, this practice produces an unstable arrangement with the inherent risk of collapse and damage, especially in a darkened room.

SUMMARY OF THE INVENTION

The present invention is an improved table for slide projectors, motion picture projectors and the like that is easily and quickly adjustable to place the table top at a selected angle with respect to the horizontal such that a projector being supported has its image projected at a desired height on the viewing surface, and that is foldable for ease of storage when not in use. The projector is used with its normally extendable feet in the fully retracted condition representing its most stable configuration with the adjustment of the angle of the table top of my invention advantageously providing the control for the height of the projected image. The combination of the projector and my table thereby provides a safe, stable arrangement that can be quickly and easily adjusted.

My novel adjustable table may be of simple, lightweight construction, and the desired adjustments, as well as folding of the table for storage, can be performed rapidly and accurately. The table can be readily and securely locked in any of its possible positions including the completely folded position.

It is therefore a primary object of my invention to provide a table for slide projectors, motion picture projectors, and the like that is easily and quickly adjustable to place the projected image at a desired height on the viewing surface.

It is another object of my invention to provide an adjustable projector table that is collapsible for ease of storage.

It is still another object of my invention to provide an adjustable projector table that can be securely locked in the desired position thereby forming a rigid and stable support for the projector.

It is yet another object of my invention to provide a projector table that is lightweight, easy to handle and that occupies a minimum of storage space.

It is an additional object of my invention to provide a projector table that is of simple construction and that can be manufactured at low cost.

These and other objects and advantages of my invention will become apparent by reference to the drawings and the detailed description herein below.

BRIEF DESCRIPTION OF THE DRAWING

FIG. 1 is a perspective view of my adjustable projector table with the top in a level position relative to the floor surface.

FIG. 2 is a side view of my table in which the legs have been moved inwardly, causing the front edge of the top to be tilted upward, FIG. 3 is a perspective view of my table in the completely folded position, suitable for storage, FIG. 4 is an exemplary view of my table in use supporting a projector in the level condition, FIG. 5 is an exemplary view of my table in use supporting a projector in a tilted position thereby raising the projected image on the screen.

THE PREFERRED EMBODIMENT OF THE INVENTION

Figure 6:
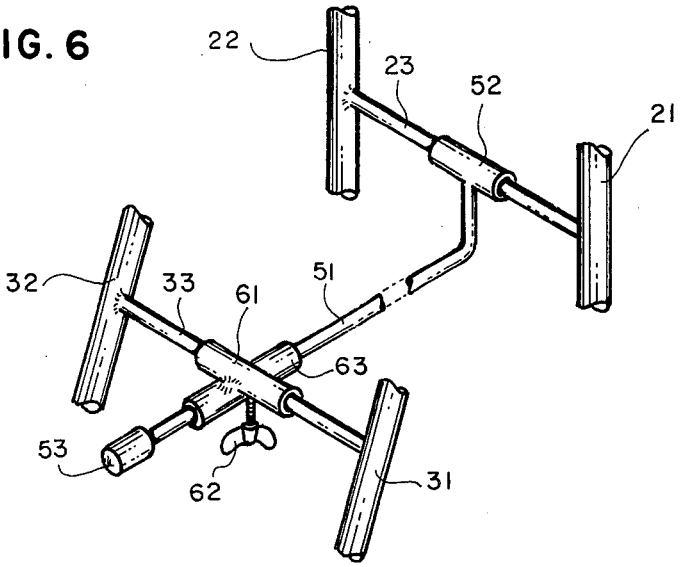
FIG. 6 is a partial view of my table showing in perspective details of the locking device.

The preferred embodiment of the adjustable projector table is shown in perspective view in FIG. 1. The table generally comprises a top 10, a rear leg assembly 20, and a front leg assembly 30 with both assemblies pivotably attached to top 10, a pair of link braces 40 and 41 connecting the rear leg assembly 30 to the front leg assembly, 30 a center link assembly 50, and a center link locking device 60.

The top 10 consists of a top surface 11, left edge surface 13, right edge surface 14 and a projector-holding cleat 12. The size of the top may be selected to hold a desired size of projector, and to provide space for placing trays and other accessories. Top 10 may be constructed of any suitable material although I prefer that it be drawn or formed from sheet metal, such as steel, for strength, lightness, and low cost.

The rear leg assembly 20 consists of a left leg 21 and a right leg 22 preferably formed from metal tubing, and a crossbar 23 welded or otherwise attached at each end between leg 21 and leg 22. The upper end of leg 21 is pivotally attached to the rear portion of edge 13 by pivot pin 24 and the upper end of leg 22 is pivotally attached to edge 14 by pivot pin 25 (seen in FIG. 3). The front leg assembly 30 is similarly constructed and consists of legs 31 and 32 joined by cross bar 33, and pivotally attached to edges 13 and 14 of top 10 by pivot pins 34 and 35. A rubber tip 25 is placed on the lower end of each leg to prevent the table from slipping on smooth floor surfaces. The front leg assembly attachment points are preferably set back from the front edge of top 10 to minimize the floor space required for the table.

On the left side of the table, front leg 31 and rear leg 21 are connected by a link brace 40 which has its forward and rearward ends pivotally connected to the respective legs and which extends in a generally rearwardly and downwardly direction.

As may now be recognized, and as best seen in FIG. 2, a front leg 31, a top edge 13, a rear leg 21, and a link brace 40 form a quadrilateral whose angles can be controlled by relative motion of the assemblies. To secure the leg assemblies, braces, and top in a selected position, I have provided center link assembly 50 and center link locking device 60, shown in more detail in FIG. 6. The link assembly 50 includes bar 51 having an upward-projecting portion disposed at its rearward end, a tubular element 52 welded or otherwise attached to the upward projecting portion, and a stop cap 53 affixed to the forward end of bar 51. Tubular element 52 embraces cross bar 23 allowing bar 51 to pivot about cross bar 23. Locking device 60 comprises a first tubular element 61 embracing and pivotable about cross bar 33. Second tubular element 63 is attached at right angles to first tubular element 61, preferably by welding, with bar 51 slidably installed therethrough. The lower wall of tubular element 63 is drilled and threaded to accept lock-screw 62 which may be tightened against bar 51 with the fingers thereby firmly securing the table assembly in a position determined by the position of slidable bar 51. Stop cap 53, attached to the forward end of bar 51 provides a stop to prevent bar 51 from sliding free of tubular element 53.

Having described the pertinent structure of my adjustable projector table, I will now explain the use of the table and the range of usable positions that can advantageously be achieved. FIG. 1 illustrates a basic position in which front leg assembly 30 and rear leg assembly 20 are spread to the maximum extent allowable by stop cap 53 which is in contact with tubular element 63. I prefer that the length of bar 51 be selected so that top surface 11 is level and parallel with the floor surface in this position. Referring to FIG. 4, a side of my table is shown for this level-top position with a typical projector 70 operating thereon. The exemplary projector 70 has extendable front feet 73 that are shown in a fully retracted position such that the center line 72 of the projected light beam 71 is parallel with the floor surface. The projected image falling on the screen or viewing surface will be at its lowest position with respect to the floor.

When it is desirable to raise the projected image, in accordance with my invention, such adjustment can be made quickly, accurately, and to a much greater degree than is possible by adjusting the projector feet. Turning to FIG. 2, a side view of my table is shown in which the top 10 has been tilted, advantageously raising the front edge of the top. To change from the level top condition of FIG. 1, the operator loosens lock-screw 62, and lifts the front end of top 10 causing front leg assembly 30 to move back, as at D, and rear leg assembly 20 to move forward as at E. Bar 51 moves forward as at C and top 10 tilts upward as at arc A. The effect of this adjustment can be seen in FIG. 5 with the center line 72 of the projected beam 71 making angle $\theta$ with the floor. Thus, the projected image is raised with respect to the floor. When the operator has the image positioned at the desired height, he tightens lockscrew 62, which again firmly locks the assembly in the new position.

It is in this position that cleat 12 comes into play to act as stop to prevent the projector from sliding by contacting projector feet 73.

In my preferred embodiment, I selected the dimensions of the elements of my table so that for all practical tilted positions of top 10, the distance between the lower ends of the leg assemblies is greater than the length of top 10 assuring that center of gravity of a projector will be well between the legs for maximum stability.

When it is desired to store the projector table, the operator can collapse the assembly in accordance with my novel design. By loosening lock screw 62, grasping the front edge of top 10, and lifting the table from floor, the table will collapse and fold as seen in FIG. 3. As the table folds, bar 51 rotates with respect to cross bar 23, and locking device 60 rotates with respect to cross bar 33. The bent or upward-turned rearward end of bar 51 allows the forward end of bar 51 to clear the rear edge of top 10 and leg assemblies 20 and 30 to come completely together. After the table is completely folded, lock-screw 62 is tightened, locking the assembly in the closed position. Advantageously, this novel locking feature permits safe handling of the folded table during storage. There is no danger of injury of inconvenience due to the table reopening as is common with prior art folding tables.

Figure 7:
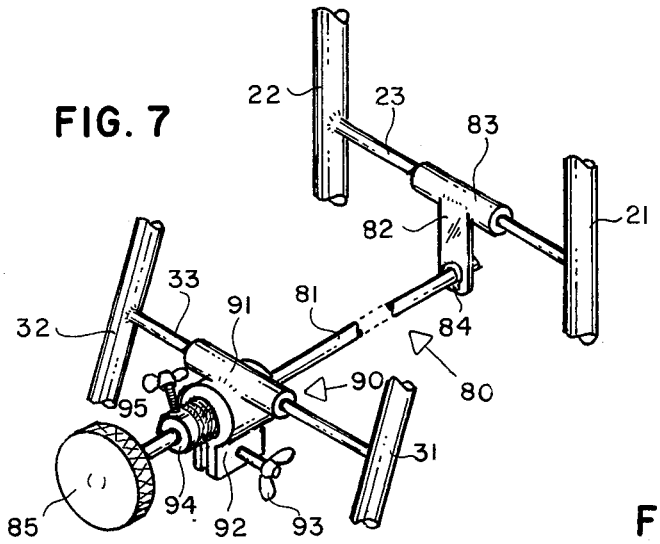
FIG. 7 is a partial view of an improvement to my table showing in perspective details of an improved vernier tilt adjustment and locking device.
Figure 8:
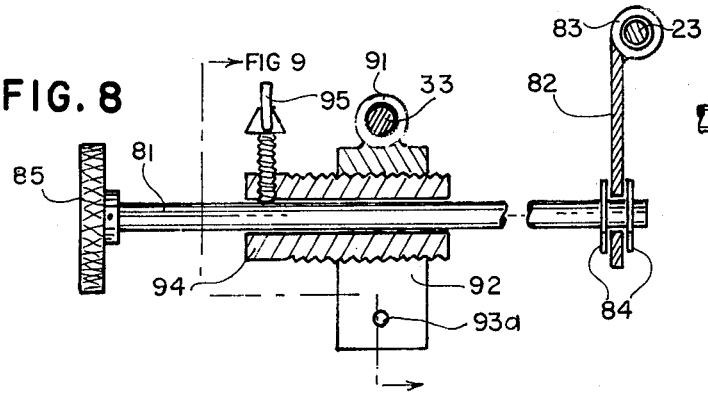
FIG. 8 is a partial and sectional view of the improvement of FIG. 7, and, FIG. 9 is a cross-sectional view, partially cutaway, of the detail of FIG. 8.
Figure 9:
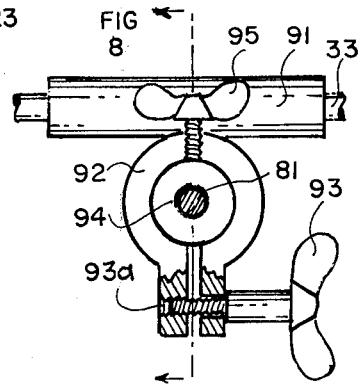

The preferred embodiment described hereinabove, provides a simple low cost and easily adjustable projector table. However, an improvement in the adjustment means of my projector table which may be particularly advantageous is shown in perspective view in FIG. 7. In this alternative embodiment, I have modified the locking device to provide a simple vernier tilt adjustment allowing the operator to smoothly and precisely position the projected image vertically on the screen. FIG. 7 illustrates the modified locking device with FIG. 8 and FIG. 9 showing additional details. Turning to FIG. 7, locking rod 81 is rotable in arm member 82, which is rotable about cross brace 23 by means of sleeve 83 to which it is attached. Locking rod 81 is slidable within collar 94 which threadably engages locking device 90 composed of clamp 92 and tube 91, and locking screw 93. The front end of locking rod 81 has hand-wheel 85 attached thereto. In use, lock-screw 95 on collar 94 is loosened and rod 81 is moved through collar 94 to obtain a rough setting of the table top tilt, and lock screw 95 is tightened. Clamp screw 93 is next loosened, allowing collar 94 free to rotate within a threaded section of locking device 92. Hand-wheel 85 may then be turned causing the rod 81 to advance or retard, depending on the direction of rotation of hand-wheel 85. As this occurs, the projected image will move up or down on the screen, and may be accurately positioned in this manner. When the desired position is achieved, clamp screw 93 is tightened, locking the threaded collar 94 in the selected position.

Details of the vernier tilt device may be seen in FIGS. 8 and 9. FIG. 8 shows collar 94 in cross-section and locking device 90 in cross-section. Locking clamp 92 is welded or otherwise attached to a short section of tubing 91, which embraces brace 23 and comprises a split-ring type device with internal threads as also seen in FIG. 9 in which the lower part of claim 92 is shown in cutaway view, illustrating threaded hole 93A and locking screw 93. In FIG. 8, arm member 82 may be seen to be welded to short tubing section 83, which pivots around brace 23. Rod 81 passes through a hole in the lower end of arm member 82, and has to grooves cut, one on either side of arm member 82 for accepting snap rings 84 on the either side of arm member 82. Thus, rod 81 is captive in the hole in arm member 82, yet is free to rotate in accordance with my invention.

While I have shown preferred methods of construction of my adjustable projector table, it is clear that various in the implementation of my invention may be made by those skilled in the art without departing from the spirit or scope of my invention. For example, while I have shown positive locking devices using clamp screws, other devices such as ratchets, cam locks, wedges, and the like could be used. Similarly, various materials such as wood, metal extrusions, castings, and like are suitable for construction of my table. Other modifications that are obvious to those of ordinary skill in the art include the addition of extensible elements to the legs of my table to provide adjustment of the table top height, variations in the size of the top, attachment of the legs, and the like. Another example is the means shown for preventing a projector from sliding on the top when the top is in a tilted position. While I prefer a simple low-cost cleat, which may be formed from sheet metal and spot-welded to the top, another low-cost means that would serve is a depressed area formed in the top into which projector feet could drop.

Since such numerous modifications and changes will readily occur to those skilled in the art, I do not desire to limit the invention to the exact construction shown hereinabove, and accordingly all equivalents which may be resorted to are considered to fall within the scope of the invention as claimed.

I claim:

1. An adjustable table for supporting a slide projector or the like, comprising:

a tiltable table top having a front and rear section;

a rear leg assembly pivotably attached to said rear section of said top;

a front leg assembly pivotally attached near said front section of said top;

linking means pivotally connecting said rear leg assembly and said front leg assembly; and locking means associated with said front leg assembly and said rear leg assembly for selectively locking said top, said front and rear leg assemblies, and said linking means in a fixed relationship, said locking means arranged to permit continuous adjustment of such relationship;

whereby said table top can be continuously adjusted and locked to selected angular positions with respect to said leg assembly and said table can be folded and locked in a folded position for storage.

2. The table as defined in claim 1 in which:

said rear leg assembly comprises a pair of rear legs and a rigidly attached rear crossbar extending therebetween;

said front legs and a rigidly attached front crossbar extending therebetween; and said linking means comprises a center link having an end attached to said rear crossbar in a manner to be laterally rotable about said crossbar, and a clamping device attached to said front crossbar, said clamping device arranged to clamp said center link in a selected fixed relationship with said front crossbar.

3. The table as defined in claim 1 in which said tiltable table top includes means for preventing articles disposed on said top from sliding when said top is locked in a tilted position with respect to floor level.

4. The table as defined in claim 2 in which said locking means further comprises vernier adjustment means whereby precise adjustments in a selected angular position of said table top with respect to said leg assemblies can be made after an initial approximate adjustment has been made.

5. An adjustable table for supporting a slide projector or the like comprising:

a tiltable table top having a front and rear section;

a rear leg assembly pivotably attached to said rear section section of said top comprising a pair of rear legs and a rigidly attached rear crossbar extending therebetween;

a front leg assembly pivotably attached near said front section of said top comprising a pair of front legs and a rigidly attached rear crossbar extending therebetween;

linking means pivotally connecting said rear leg assembly and said front leg assembly; locking means comprising a center link rod having one of its ends laterally rotably attached to said rear crossbar and a clamping device attached to said front crossbar, said center link rod also longitudinally rotable with respect to said rear crossbar, said center link rod having a hand wheel attached to the other end of said rod; and vernier adjustment means associated with said locking means compising a tubular collar slidably engaged with said center link rod, said tubular collar having a locking screw for locking said collar to said rod in a selected position along said rod, such selected position representing an initial approximate adjustment of the angle of said table top, said tubular collar having external screw threads thereon, and said clamping device including internal screw threads threadably engaged with said external threads of said tubular collar;

whereby rotation of said center link rod by means of said handwheel when said tubular collar is locked to said rod by means of said locking screw causes small angular changes in position of said table top, thereby permitting precise adjustments in the angular position of said table top with respect to said leg assemblies to be made after an initial approximate adjustment has been made.

6. The table as defined in claim 5 in which said clamping device includes means for clamping said tubular collar thereby permitting said collar to be locked in a selected position.

7. A projector table for supporting a slide projector or the like and for permitting accurate adjustment of the height above floor level of the projected image therefrom on a viewing screen, comprising:

a tiltable table top having a front and a rear portion;

a pair of rear legs having a rear crossbar rigidly attached therebetween, said rear pair of legs pivotally attached to said rear portion of said top so as to be pivotable in a fore and aft direction;

a pair of front legs having a front crossbar rigidly attached therebetween, said front pair of legs pivotally attached to said front portion of said top so as to be pivotable in a fore and aft direction;

a pair of side links pivotally connecting said pair of front legs to said pair of rear legs;

a center link having front and rear sections, said rear section hingedly attached to said rear crossbar; and clamping means hingedly attached to said front crossbar and having a tubular portion disposed in slidable relationship with said front section of said center link and a locking screw in said tubular portion for locking said center link to said front crossbar in a selected position;

whereby loosening of said locking screw permits independent movement in a fore or aft direction of said front pair of legs and said rear pair of legs, such movement resulting in tilting of said table top with respect to floor level causing the projected image from a slide projector supported by said top to be raised or lowered on a viewing screen and whereby tightening of said locking screw secures said table in a selected angular position with respect to floor level.

* * * * *

UNITED STATES PATENT AND TRADEMARK OFFICE

CERTIFICATE OF CORRECTION

PATENT NO. : 4,040,585

DATED : August 9, 1977

INVENTOR(S) : Eduardo L. Socas

It is certified that error appears in the above-identified patent and that said Letters Patent are hereby corrected as shown below:

Column 5, line 63 (patent claim 2), between "said" and "front legs", insert the following:
--front leg assembly comprises a pair of--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*